US005239976A

United States Patent [19]

Specht

[11] Patent Number: 5,239,976

[45] Date of Patent: Aug. 31, 1993

[54] COMPOUND ARCHERY BOW HAVING A CARRYING ADAPTOR MOUNTED THEREON

[76] Inventor: John J. Specht, 23 Melrose Rd., Bristol, R.I. 02809

[21] Appl. No.: 737,440

[22] Filed: Jul. 29, 1991

[51] Int. Cl.[5] ..... F41B 5/00

[52] U.S. Cl. ..... 124/88; 124/23.1; 224/257; 224/268; 224/916

[58] Field of Search ..... 224/916, 257, 258, 271, 224/272, 268, 269, 252, 202, 103; 124/86, 88, 23.1

[56] References Cited

U.S. PATENT DOCUMENTS

| | | | |
|---|---|---|---|
| 390,320 | 10/1888 | Vallee | 224/202 |
| 523,828 | 7/1894 | Bickerstaff | 224/272 |
| 2,743,894 | 5/1956 | Ostnas | 224/271 |
| 3,502,062 | 3/1970 | Shurts | 124/23.1 |
| 4,121,743 | 10/1978 | Burton | 224/916 |
| 4,424,923 | 1/1984 | Bingham | 224/251 |
| 4,596,228 | 6/1986 | Smith | 124/88 |
| 4,628,893 | 12/1986 | Shaw, III | 124/23.1 |

*Primary Examiner*—Linda J. Sholl

*Attorney, Agent, or Firm*—Salter, Michaelson & Benson

[57] ABSTRACT

An adaptor device for use in the carrying of a compound archery bow having a cable bar attached thereto, the adaptor device including a body portion through one end of which a bore extends for receiving the cable bar therein, the body portion being secured to the cable bar in a selected position thereon, and the body portion being mountable on a carry member in supported relation wherein the bow is supportable by the adaptor body portion on the body of the user in a carrying position which provides for convenient access to the bow by the user.

5 Claims, 2 Drawing Sheets

COMPOUND ARCHERY BOW HAVING A CARRYING ADAPTOR MOUNTED THEREON

BACKGROUND OF THE INVENTION

The present invention relates to an adaptor device for use in the carrying of a compound archery bow, the invention utilizing the conventional cable bar of the compound bow for the purpose of carrying the bow on the body of the user in a position of non-use.

Prior to the instant invention, some efforts have been made to provide a holster, or carrying means, for archery bows so as to enable the user to conveniently carry the bow in a position of non-use, but to have the bow accessible when use is required. Examples of slings and/or holsters for carrying bows of various types are illustrated in the U.S. Pat. No. 3,232,501 to Merenda; Burton U.S. Pat. No. 4,121,743; Hughes U.S. Pat. No. 4,760,944; Burgwin U.S. Pat. No. 4,684,047; and Davis U.S. Pat. No. 4,768,689. The bows, holsters and sling assemblies as illustrated in these aforesaid patents apparently performed the function as illustrated and described, but were of complex construction and relatively expensive in the manufacture thereof, and therefore were not found to be commercially acceptable.

Some efforts have also been made to provide a bow holster or the like for compound archery bows, and examples of this type of device are illustrated in the Lyons et al U.S. Pat. No. 4,103,807 and Youngbauer U.S. Pat. No. 4,621,752. Both of these holster devices for compound bows disclose the mounting of the compound bow on a device that is secured to the belt of the user, but these devices are unrelated to the essential feature of construction of the subject invention.

In the Hayes U.S. Pat. No. 4,478,203; Troncoso U.S. Pat. No. 4,542,732; Quartino et al U.S. Pat. No. 4,452,222; and Smith U.S. Pat. No. 4,596,228, compound archery bows are illustrated that include the conventional cable guard or bar and that incorporate a cable separator therein. The cable separator as shown in the Smith Patent is mounted on the cable bar and includes spaced grooves for separating the cables. The Hayes Patent shows another form of a tension cable guide having a cable bar and that includes a plastic guide that is mounted on the cable bar, while the Quartino et al Patent incorporates an adaptor device for separating the cable members from each other. The Troncoso Patent utilizes a different form of cable guide slide for separating the cables from each other. In all of these latter referred-to patents that illustrate compound bows therein, the cable bar is used specifically for mounting an adaptor thereon that has a primary function of separating the cables but does not incorporate a carry device that is the subject matter of the present invention.

As will be described hereinafter, the adaptor device of the subject invention provides for the carrying of a compound archery bow by utilizing the cable bar, and has a specific constructional arrangement for assisting in the carrying of the bow in a ready position; and although the subject invention is simple in construction, it is uniquely different from the prior art devices as discussed hereinabove.

SUMMARY OF THE INVENTION

The present invention relates to an adaptor device for use in the carrying of a compound archery bow, that has a cable bar attached thereto. In one form of the invention, the adaptor device includes a body portion through one end of which a bore extends for receiving the cable bar therein, the adaptor device being secured to the cable bar in a selected position of use thereon. A carry construction is formed on an end of the body portion that is opposite to the end in which the bore is formed, a carry member in the form of a sling being mounted on the body of a user of the bow and being engageable with said carry construction, wherein the bow is supportable by the adaptor device body portion and said carry member on the body of the user in a carrying position which provides for convenient access to the bow by the user.

In another form of the invention, the adaptor device includes a body portion that is mounted on the cable bar, the body portion being removably engageable with a carry member that is mounted on the body of the user. In the alternate form of the invention, the carry member is secured to the belt of the user so that the bow is conveniently mounted at the user's belt for easy carrying and accessibility.

Accordingly, it is an object of the present invention to provide an adaptor device for use in the carrying of a compound archery bow having a cable bar attached thereto wherein the adaptor device is engageable with a carry member for supporting the bow on the body of the user in a carrying position.

Other objects, features and advantages of the invention shall become apparent as the description thereof proceeds when considered in connection with the accompanying illustrative drawings.

DESCRIPTION OF THE DRAWINGS

In the drawings which illustrates the best mode presently contemplated for carrying out the present invention.

DESCRIPTION OF THE PREFERRED EMBODIMENTS

Figure 1:
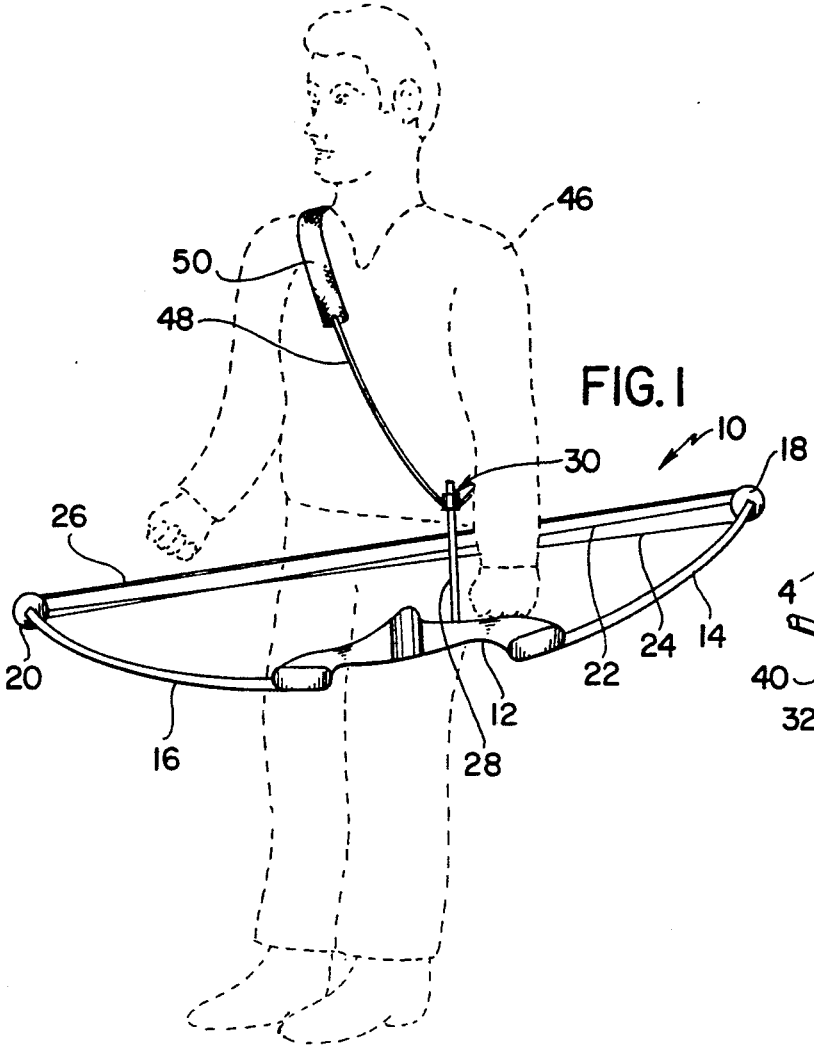
FIG. 1 is a perspective view of one form of the adaptor device as embodied in the present invention showing a compound bow as mounted on the body of the user by a carry member in the form of a sling.

Referring now to FIG. 1, a compound bow with which the subject matter of the present invention is used is illustrated and is generally indicated at 10. The compound bow 10 includes a handle portion 12 to which conventional curved bow limbs 14 and 16 are joined at the opposite ends thereof. Conventional wheels or pulleys 18 and 20 as applicable in compound bows are secured to the limbs 14 and 16, respectively, and receive therearound cables 22 and 24 that are operable in the conventional manner. A bow string 26 extends around the wheels 18 and 20, as is well known in compound bow constructions.

As further illustrated in FIG. 1, a cable guard or bar 28 is secured to the handle portion 12 and extends outwardly therefrom, and is normally usable in the conventional manner that provides for separation of the cables 22 and 24. Although not illustrated, a device can also be mounted on the cable bar 28 for receiving the cables 22 and 24 therein for maintaining the proper separation thereof. As is described, the compound archery bow 10 is of conventional construction, and forms no part of the present invention except in the field of use to which the subject invention pertains.

Figure 2:
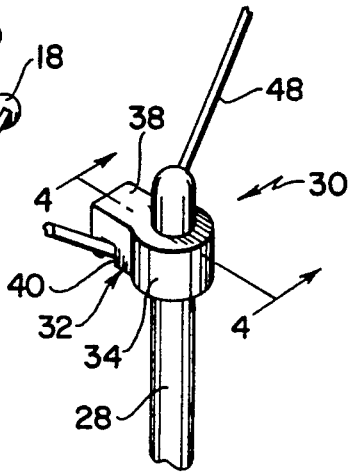
FIG. 2 is an enlarged perspective view of the adaptor device illustrated in FIG. 1 showing the manner in which the sling as defined by a carrying cord is received therein.
Figure 3:
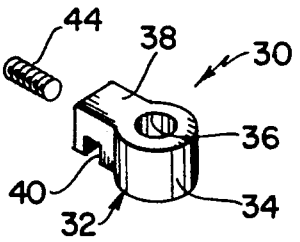
FIG. 3 is a perspective view of the adaptor device wherein a set screw as provided therein is shown in exploded form.
Figure 4:
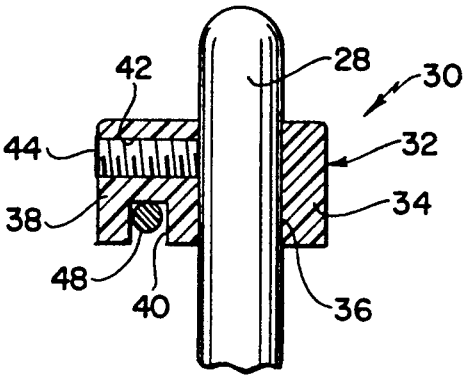
FIG. 4 is a sectional view taken along line 4—4 in FIG. 2.

Referring now to FIGS. 2, 3, and 4, one form of the present invention is illustrated and includes an adaptor device that is generally indicated at 30. The device 30 includes a body portion generally indicated at 32 that is defined by a first enlarged rounded portion 34 through which a bore 36 completely extends. Joined to the enlarged portion 34 is a second portion 38 that is substantially square in cross section, and as shown in FIG. 4, the body portion 32 as defined by the portions 34 and 38 is molded in a single unitary construction of a suitable plastic material.

Formed on the underside of the second portion 38 of the body portion 32 is a groove 40, the longitudinal axis of which is displaced from the axis of the bore 38, but that is located substantially perpendicular with respect thereto. As shown in FIG. 4, the groove 40 also is formed with square interior corners, the purpose of which will be described hereinafter. Extending through the second portion 38 and displaced from the groove 40 is a threaded opening 42 that communicates with the bore 36. The axis of the threaded opening 42 is also disposed in perpendicular relation with respect to the axis of the bore 36. Located in the threaded opening 42 is a threaded set screw 44 that is axially adjustable for engagement with the cable bar 28 which as more clearly illustrates in FIGS. 2 and 4 is received in the bore 36 of the adaptor device 30.

The purpose of the adaptor device 30 is to mount the compound bow 10 on the body of a user indicated in phantom at 46. For this purpose, a carrying member 48 is provided, and as illustrated in FIG. 1, is shown in the form of a flexible cord 48. Joined to the flexible cord 48 at the opposite ends thereof is a strap portion 50 that is located around the shoulder of the user 46 to aid in the carrying of the bow 10 in a comfortable manner.

Referring to FIGS. 2 and 4, the adaptor device 30 is shown in a selected position of use as mounted on the cable bar 28, the groove 40 facing downwardly and receiving the carrying member 48 therein. As the carrying member has a generally circular cross-sectional configuration, the square corners of the groove 40 tend to aid in the frictional contact therewith when the flexible carrying member 48 is placed under load, as shown in FIG. 1. Since the carrying member 48 is snugly received in the groove 40 of the adaptor device 30, and further since the adaptor device 30 is secured to the cable bar 28 of the bow 10, the location of the carrying member 48 in the groove 40 in the position as shown in FIG. 1, insures that the bow 10 is disposed in a convenient carrying position, wherein the load of the bow is carried by the shoulder strap 50 as mounted on the shoulder of the user. As illustrated, the bow 10 is in a position for immediate use by the user when disposed in the carry position. Further, the bow may be shifted to the rear of the user if it is so desired, but in all instances, the bow can be grasped by the handle portion 12 by the user for movement thereof to a position of use as desired. The location of the bow on the carrying member 48 is easily adjustable by slidably moving the adaptor device 30 on the carrying member. The adaptor device 30 is also quickly removable from the cable bar 28 when it is no longer necessary to carry the bow in an inactive position, as illustrated in FIG. 1.

It is seen that the adaptor device as embodied in the form of the invention just described is usable with the cable bar of the compound bow, and enables the bow to be carried in an inactive position without interfering with the mobility of the user, and further enables the bow to be located in a position so that it is immediately available for use as required. Further, as described, the adaptor device 30 and the carrying member 48 are conveniently removed from the cable bar when the bow is to be actively used. Because of the flexibility of the carrying member 48 and the relatively small size of the adaptor 30, they can be stored in the pocket of the user for immediate access thereto when required.

Figure 5:
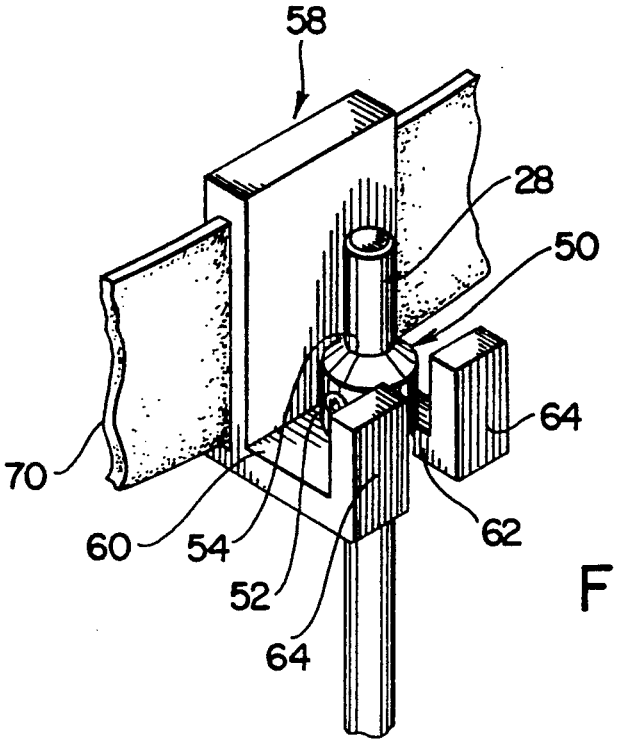
FIG. 5 is a perspective view of a modified form of the invention in which the adaptor device is mounted on the belt of the user.
Figure 6:
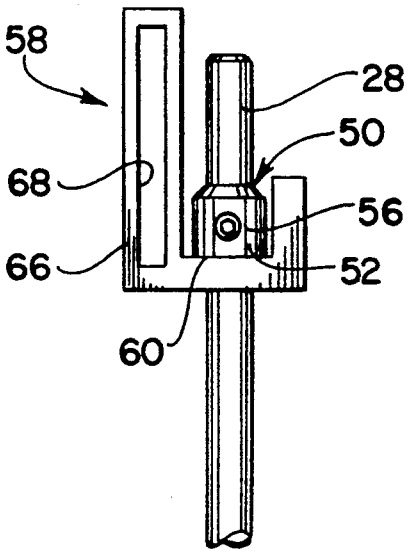
FIG. 6 is a side elevational view of the adaptor device shown in FIG. 5.

Referring now to FIGS. 5 and 6, a modified form of the invention is illustrated, and as shown, the modification is designed to enable the bow 10 to be carried on the belt of the user in an inactive position. In order to accomplish this purpose, an adaptor device generally indicated at 50 is provided. The adaptor device 50 includes a body portion 52 that is formed with an axially extending bore 54 that receives the bow cable bar 28 therein. A set screw 56 extends through a threaded opening as formed in the body portion 52 of the adaptor device 50 and locks the adaptor device in a selected position in the cable bar 28.

In order to provide for carrying the bow 10 to which the cable bar 28 is fixed in an inactive position, a carry member generally indicated at 58 is provided. The carry member 58 includes a shelf portion 60 that has a central slot 62 formed therein; and spaced apart upwardly extending feet 64 are joined to the shelf portion at the outermost end thereof. The spacing of the feet 64 corresponds to the width of the slot 62, the width of the slot 62 and the spacing of the feet 64 being dimensioned for accommodating the cable rod 28 in slidable relation therein. Joined to the rear of the shelf portion 60 and extending upwardly in parallel spaced relation with respect to the feet 64 is a clip portion 66 that has an opening 68 formed therein. The opening 68 has a rectangular configuration as seen in side elevation and is shaped and configured for receiving a belt 70 of the user therethrough, thus providing for the mounting of the carry member on the body of the user.

In use of the modified form of the invention, the carry member 58 is first mounted on the belt 70 of the user as shown in FIG. 5. The body portion 52 as secured to the cable bar 28 that is attached to the bow 10 is mounted on the carry member 58 by lifting the bow and cable bar attached thereto until the body portion 52 clears the feet 64 of the shelf portion 60. The cable bar is slidably inserted between the feet 64 and into the slot 62 as formed in the shelf portion. The bow and cable bar are then moved downwardly until the body portion 52 contacts the shelf portion 60. The cable bar and bow are thus locked in an inactive position on the carry member 58 for support by the belt 70 of the user.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A compound archery bow, comprising a handle portion, limbs joined to said handle portion and having outer ends formed thereon, cables interconnected to the outer ends of said limbs and extending therebetween a string secured between the outer ends of said limbs, a cable bar for secured to said handle portion and extending rearwardly therefrom, and an adaptor mounted on said cable bar for use in carrying said compound archery bow, said adaptor including a one-piece body portion that is defined by a first portion through which a bore having a longitudinal axis extends completely therethrough, said cable bar being received in said bore in coaxial relation to the longitudinal axis thereof for securement in a selected position therein, fastening means for securing said cable bar in said bore, said body portion including a second portion that is integrally joined to said first portion and having a top portion and an underside formed thereon, a groove extending through said second portion on the underside thereof, said groove being spaced from said bore and having a longitudinal axis that extends in a direction that is perpendicular to the longitudinal axis of said bore, an elongated flexible support member located on the body of the user of said bow, a portion of which is receivable in said groove, wherein said bow is supportable by said body portion on the body of said user in a carrying position to provide for convenient access to said bow by said user, said groove as formed in said second portion of said body portion facing downwardly as mounted on said cable bar when said bow is located in the carrying position, wherein said flexible support member as received in said groove in said adaptor supports said adaptor, the bow and the cable bar on which said adaptor is mounted, on the body of the user.

2. A compound archery bow as claimed in claim 1, a threaded opening formed in said second portion and communicating with said bore in said first portion, said securing means including a set screw that extends through said threaded opening in said second portion, and that engages said bow cable bar in said bore for locking said adaptor body portion in a selected position on said cable bar.

3. A compound archery bow as claimed in claim 2, said threaded opening extending in a direction that it is perpendicular to the longitudinal axis of said groove and said bore.

4. A compound archery bow as claim in claim 3, said second portion having an outer face through which said threaded opening extends, said set screw as located in said threaded opening being exposed for easy access thereto.

5. A compound archery bow as claimed in claim 1, said flexible support member being defined by a cord having a circular cross section, the dimensions of the width and height of said groove enabling said cord to be received therein in snug fitting relation but permitting sliding movement of said adaptor body portion relative to said cord for adjustment with respect thereto.

* * * * *